US008579634B2

(12) United States Patent
Raquin et al.

(10) Patent No.: US 8,579,634 B2
(45) Date of Patent: Nov. 12, 2013

(54) ELECTRICAL CONNECTION SYSTEM FOR A VEHICLE

(75) Inventors: Stéphane Raquin, Villefranche sur Saone (FR); Frédéric Duault, Decines (FR)

(73) Assignee: Electricfil Automotive, Miribel Cedex (FR)

( * ) Notice: Subject to any disclaimer, the term of this patent is extended or adjusted under 35 U.S.C. 154(b) by 0 days.

(21) Appl. No.: 13/383,172

(22) PCT Filed: Jul. 7, 2010

(86) PCT No.: PCT/FR2010/051432

§ 371 (c)(1),
(2), (4) Date: Jan. 31, 2012

(87) PCT Pub. No.: WO2011/004121

PCT Pub. Date: Jan. 13, 2011

(65) Prior Publication Data

US 2012/0131984 A1 May 31, 2012

(30) Foreign Application Priority Data

Jul. 9, 2009 (FR) ..... 09 54749

(51) Int. Cl.
*H01R 24/58* (2011.01)

(52) U.S. Cl.
USPC ..... 439/31; 439/731; 439/906

(58) Field of Classification Search
USPC ..... 439/31, 687, 696, 731, 906
See application file for complete search history.

(56) References Cited

U.S. PATENT DOCUMENTS

| | | | | |
|---|---|---|---|---|
| 5,158,481 | A * | 10/1992 | Frantz | 439/607.58 |
| 5,246,562 | A * | 9/1993 | Weyl et al. | 204/424 |
| 5,944,562 | A | 8/1999 | Christensson | |
| 6,866,517 | B2 * | 3/2005 | Kimata et al. | 439/33 |
| 6,878,252 | B2 | 4/2005 | Weyl et al. | |
| 7,798,855 | B2 * | 9/2010 | Gustin | 439/620.01 |
| 8,287,294 | B2 * | 10/2012 | Masuda et al. | 439/260 |
| 2002/0177341 | A1 | 11/2002 | Steinii et al. | |
| 2003/0019751 | A1 | 1/2003 | Weyl et al. | |
| 2010/0255711 | A1 * | 10/2010 | Jenving | 439/452 |
| 2012/0131984 | A1 * | 5/2012 | Raquin et al. | 73/23.31 |
| 2012/0285217 | A1 * | 11/2012 | Duault et al. | 73/1.06 |

* cited by examiner

*Primary Examiner* — James Harvey
(74) *Attorney, Agent, or Firm* — Ladas & Parry, LLP

(57) ABSTRACT

An electrical connection system for a vehicle, comprising an elongated dielectric component (3) equipped with at least one electrode electrically connected to electrical contact pads (7), two dielectric half-shells (14) assembled face-to-face, electrical contact fingers (19) connecting with the pads, interposed between at least one half-shell and the component, a spring collar (21) surrounding the half-shells (14) to provide for holding them in position. The half-shells (14) include at the proximal part a pivot (23) such that the half-shells open angularly relative to one another, the half-shells (14) together include on the outside a bearing surface for a tubular body providing for bringing the half-shells together.

11 Claims, 2 Drawing Sheets

ELECTRICAL CONNECTION SYSTEM FOR A VEHICLE

This application is a 371 of PCT/FR2010/051432 filed on Jul. 7, 2010, which claims priority to French Patent Application No. 0954749, filed Jul. 9, 2009, all of which are incorporated herein by reference.

BACKGROUND OF THE INVENTION

The present invention relates to the technical field of electrical connection systems of electrical devices for vehicles, used at high temperature, such as for example spark plugs, actuators or measurement sensors.

The object of the invention relates more particularly to an electrical connection system for an electrical device for measuring exhaust gas physical parameters or components such as temperature, mass of particles, gaseous composition, etc.

The object of the invention finds a particularly advantageous application in the field of measuring soot in exhaust gases.

In the state of the art, diverse embodiments are known of a measurement device for exhaust gases. For example, U.S. Pat. No. 5,246,562 describes a device including, within a tubular metal body, a detector embodied in the form of an elongated dielectric component having a distal part provided with at least one electrode constituting a measurement cell. This measurement cell is electrically connected to electrical contact pads provided in the proximal part of the detector. This device also includes a system for electrically connecting the detector to an electrical wiring harness. Such a connection system includes two dielectric half-shells assembled face-to-face, between which is inserted the proximal part of the detector. Fingers for making electrical contact with the pads are interposed between at least one half-shell and the detector and are electrically connected to the wiring harness. The two half-shells are held in position by means of a spring collar.

In general, it should be noted that such an electrical device mounted on a vehicle is subjected to mechanical vibrations. Hence, one of the major drawbacks of such a device relates to the difficulty of establishing and maintaining over time an effective electrical connection between the detector and the electrical contact fingers. To attempt to correct this flaw, U.S. Pat. No. 6,878,252 proposes to create an assembly of the half-shells by providing protuberances and cavities on each of them, mutually cooperating so as to avoid relative motion between the two half-shells that would be liable to spoil the electrical connection between the contact pads and the electrical fingers.

This technical solution requires the manufacture of shells having relatively complex shapes. Further, such a device has considerable bulk, which constitutes a disadvantage in many applications.

The present invention therefore aims to remedy the disadvantages of the state of the art by proposing a new electrical connection system for vehicles, used at high temperature, having a simple design and limited bulk, designed to reliably provide an electrical connection with the electrode of the dielectric component, regardless of the vibratory loads to which such an electrical device is subjected.

To attain such an objective, the electrical connection system for vehicles between electrical contact pads arranged on the proximal part of an elongated dielectric component and an electrical wiring harness comprises:

- two dielectric half-shells assembled face-to-face so as to have on one side a distal part and on the opposite side a proximal part, the proximal part of the component being inserted between the two half-shells on the side of the distal part,
- fingers for electrical contact with the pads, interposed between at least one half-shell and the component, and electrically connected to the wiring harness,
- a spring collar surrounding the half-shells to ensure that they are held in position. According to the invention:
- the half-shells include, at the proximal part, a pivot such that the half-shells open angularly relative to one another in the direction of the distal part, the spring collar surrounding the half-shells at the proximal part to hold them in the open angular position,
- the half-shells together include externally, at the distal part, a bearing surface for a tubular body bringing the two half-shells together to ensure electrical contact between the contact fingers and the pads.

According to one feature of the invention, the spring collar is assembled on the half-shells such that the half-shells and the spring collar are assembled inside the tubular body.

According to a preferred embodiment, the spring collar is assembled in a rebate provided externally on the half-shells.

Advantageously, the half-shells together delimit, at the proximal part, a contact area constituting the pivot.

According to one variation in implementation, each contact finger includes at least one spring portion kept under tension by a half-shell.

According to another variation of implementation, the contact fingers each include at least one ductile portion.

For example, the half-shells together delimit a recess for receiving the proximal part of the component, having a stop surface for said component.

According to one variation of implementation, the contact pads are electrically connected to at least one electrode borne by the detector.

For example, the contact fingers extend outside the half-shells, on the side of the proximal part, to allow their connection to the wiring harness.

According to one advantageous embodiment, the half-shells have, at their distal part, a chamfer that assists insertion into the tubular body.

Another object of the invention is to propose a system, conforming to the invention, for electrical connection between an electrical wiring harness and an elongated dielectric component constituting a detector, particularly of soot in exhaust gases.

Another object of the invention is to propose an electrical device for a vehicle that includes a system, conforming to the invention, for electrical connection between a wiring harness and a spark plug.

Various other features appear from the description given below with reference to the appended drawings which show, by way of non-limiting examples, embodiments of the object of the invention.

DETAILED DESCRIPTION OF THE INVENTION

Figure 1:
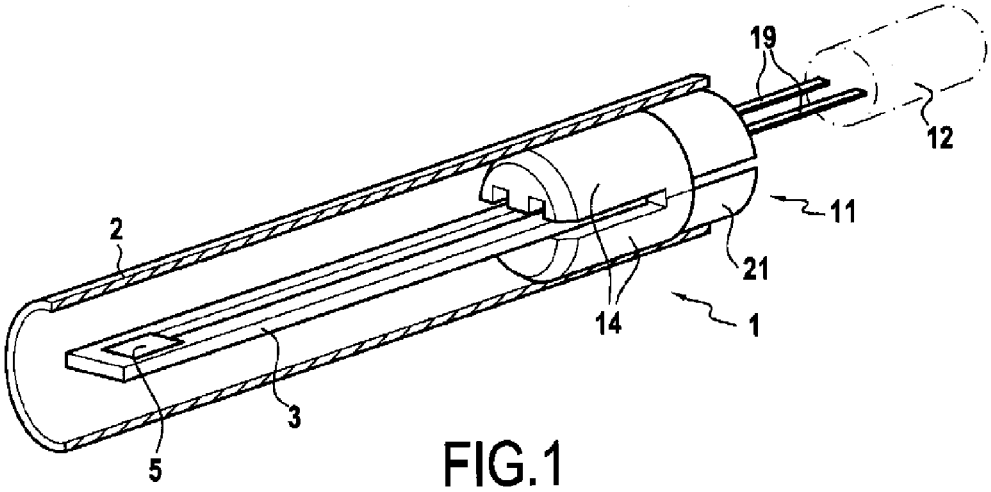
FIG. 1 is a partial cutaway view of an embodiment of an electrical device conforming to the invention.
Figure 2:
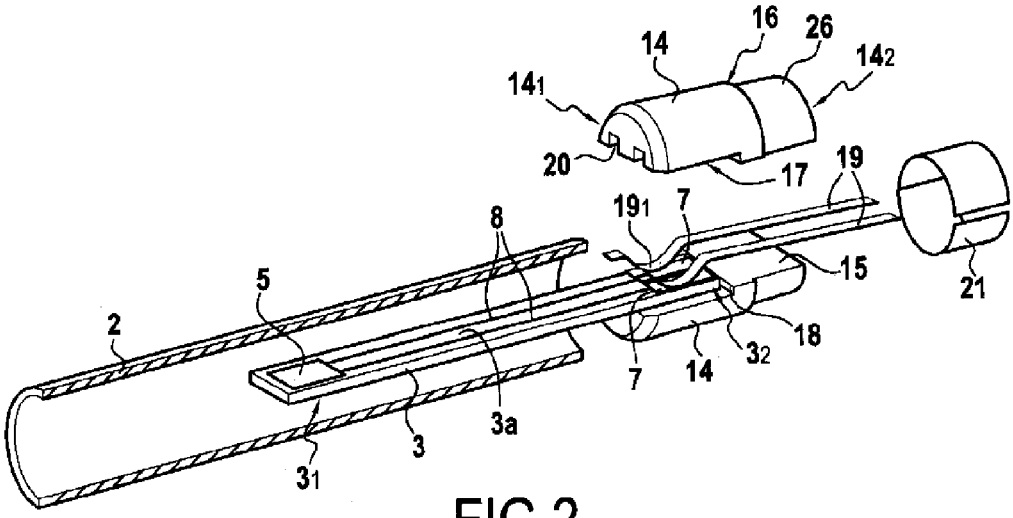
FIG. 2 is an exploded view of the device illustrated in FIG. 1.
Figure 3:
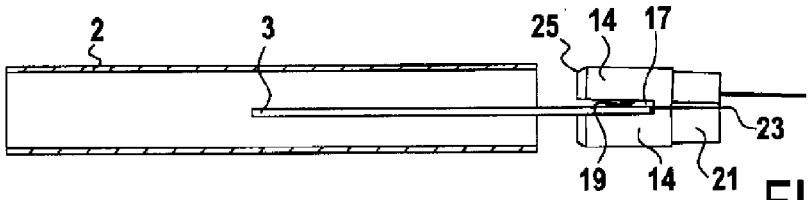
FIGS. 3 through 5 are partial elevation section views showing three steps in assembling the electrical device conforming to the invention.
Figure 4:
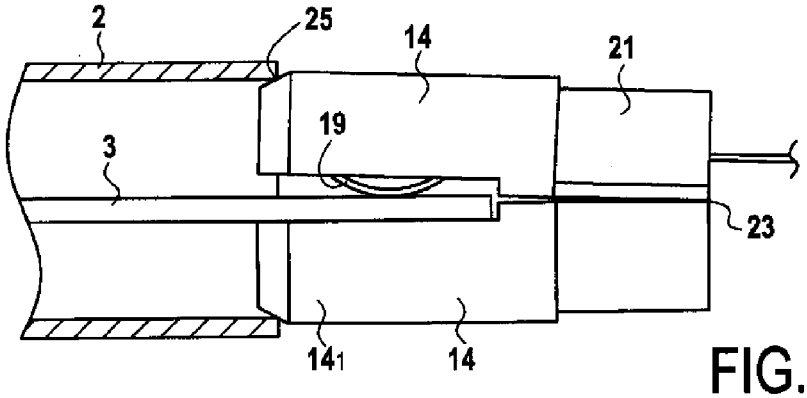
Figure 5:
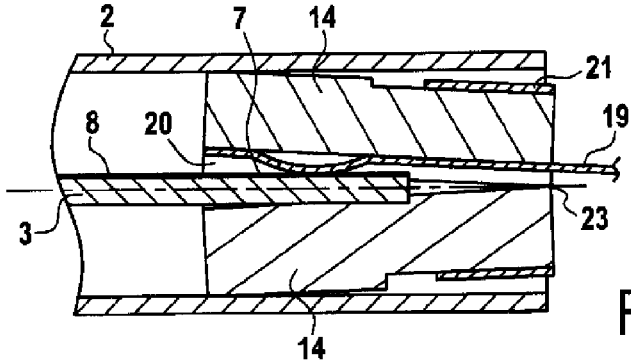

The embodiment illustrated in FIGS. 1 through 5 describes an electrical device 1 for a vehicle designed to constitute a sensor for the measuring of physical parameters generally, or of components in exhaust gases such as temperature, mass of particles, gaseous composition. Advantageously, the device 1 is a sensor for measuring soot in exhaust gases.

Such an electrical device 1 comprises a tubular metal body 2 having preferably a right circular transverse section. The electrical device 1 also includes an elongated dielectric component 3 which, in the example illustrated, is a detector embodied in the form of an elongated wafer of generally rectangular shape. Advantageously, this dielectric wafer 3 is made of ceramic. This detector 3 has a distal part $\mathbf{3}_1$ and opposite that a proximal part $\mathbf{3}_2$. This detector 3 is provided at its distal part $\mathbf{3}_1$ with at least one electrode 5 constituting, in the embodiment illustrated, a measurement cell electrically connected to electrical contact pads 7 arranged at the proximal part $\mathbf{3}_2$ of the wafer, and two in number in the example illustrated in FIGS. 1 through 5.

Of course, the measurement cell 5 is made in an appropriate manner according to the intended application. For example, this measurement cell 5 can include two electrodes between which the quantity of soot deposited is measured. This measurement cell 5 is electrically connected to the contact pads 7 using electrical connections 8 preferably embodied in electrically conductive traces arranged on and/or in the dielectric wafer 3. In the example illustrated, the measurement cell 5, the conductive traces 8 and the contact pads 7 are carried on a principal face 3*a* of the detector 3.

According to one preferred embodiment, the detector 3 is provided, at its distal part $\mathbf{3}_1$ with a resistor located facing the measurement cell for regenerating this cell. This resistive heating element is electrically connected by conductive traces 8 all the way to electrical contact pads 7 arranged at the proximal part $\mathbf{3}_2$ of the detector 3. As appears from the embodiment illustrated in FIG. 6, this resistive heating element, the conductive traces 8 and the contact pads 7 are arranged on the principal face 3*b* opposite the principal face 3*a* bearing the measurement cell 5.

In conformity with the invention, the electrical device 1 includes an electrical connection system 11 providing an electrical connection between the electrode 5 and an electrical wiring harness 12. The electrical connection system 11 includes two dielectric half-shells 14 assembled face-to-face so as to have a right transverse section corresponding to the right transverse section of the metal tubular body 2. In the example illustrated, each dielectric half-shell 14 thus has a semicircular right transverse section. Each half-shell 14 thus has a flat 15 connected with a semicircular outside contour 16. The half-shells 14 are arranged so that their flats 15 are located face-to-face or opposite one another so that, together, the half-shells 14 have a circular shape.

The dielectric half-shells 14 have, on one side oriented toward the distal part $\mathbf{3}_1$ of the detector, a distal part $\mathbf{14}_1$ and on the opposite side a proximal part $\mathbf{14}_2$. As is clearly perceived from the figures, the proximal part $\mathbf{3}_2$ of the detector 3 is inserted between the two half-shells 14 on the side of the distal part $\mathbf{14}_1$. More precisely, the detector 3 is inserted between the two flats 15 of the two half-shells 14.

According to a preferred variation in implementation, the half-shells 14 together delimit a recess 17 for receiving the proximal part $\mathbf{3}_2$ of the detector 3, provided starting at the distal part $\mathbf{14}_1$ of the half-shells 14. This recess 17 is provided in the flats 15 of the half-shells 14 and thus defines by its closed end a stop 18 limiting the insertion of the detector 3 inside the half-shells 14.

Figure 6:
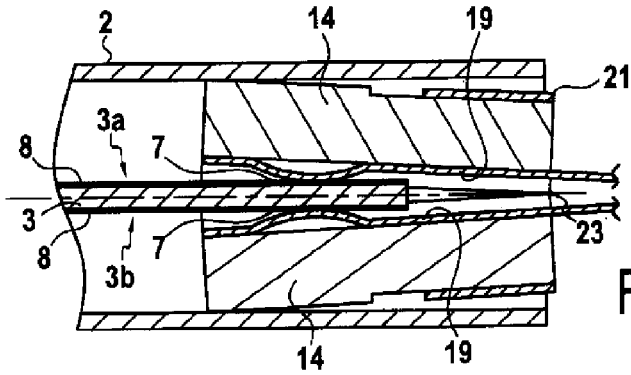
FIG. 6 is an elevation section view showing another embodiment of a device conforming to the invention.

The electrical device 1 also has fingers 19 for electrical contact with the pads 7 of the detector 3. These contact fingers 19 are interposed between at least one half-shell 14 and the detector 3. In the example illustrated in FIGS. 1 through 5, two electrical contact fingers 19 are mounted side-by-side between one face of the detector 3 and a half-shell 14. Of course mounting a different number of electrical contact fingers can also be contemplated. For example, it is conceivable, as illustrated in FIG. 6, to also mount one or two electrical contact fingers 19 between the other face of the detector 3 and the other half-shell 14. Each contact finger 19 is in contact with a pad 7 of the detector 3 and is connected in an appropriate manner to the electrical wiring harness 12.

According to a preferred variation in implementation, each contact finger 19 is held in position inside a groove 20 provided in the flat 15 of the half-shell 14, from the distal part $\mathbf{14}_1$ to the proximal part $\mathbf{14}_2$.

In the example illustrated, the contact fingers 19 extend outside the half-shells 14, on the side of the proximal part $\mathbf{14}_2$ to allow its connection to the electrical wiring harness 12. Of course, the contact fingers 19 can have a length that is less than the length of the half-shells 14 such that the connection with the wiring harness 12 can be made within the half-shells 14.

According to a preferred variation in implementation, each contact finger 19 includes at least one spring portion $\mathbf{19}_1$ which advantageously is in contact with a contact pad 7. Thus, each contact finger 19 is a flat element provided with a semicircular part forming the spring portion $\mathbf{19}_1$ and having a height that is greater than the depth of the groove 20 so as to be in contact with a pad 7. It should be noted that each contact finger 19 can have, in the place of a spring portion, a ductile or deformable portion.

The electrical connection system 11 also includes a spring collar 21 surrounding the half-shells 14 to ensure that they are held in position. In the example illustrated, the spring collar 21 is made in the shape of an open ring surrounding the two half-shells 14.

In conformity with the invention, the half-shells 14 have, at the proximal part $\mathbf{14}_2$, a pivot 23 such that the half-shells 14 open angularly relative to one another in the direction of the distal part $\mathbf{14}_1$. As is revealed more precisely by FIGS. 3 through 5, the spring collar 21 surrounds the half-shells 14 at the proximal part $\mathbf{14}_2$ such that the half-shells 14 are held tightly and in contact with one another on the proximal part of the flats 15, thus forming the pivot 23. Inasmuch as the detector 3 is inserted between the half-shells 14, on the side of the distal part $\mathbf{14}_1$, with the contact fingers 19 interposed between the detector 3 and one or both of the half-shells 14, these two half-shells 14 are not parallel to one another. As clearly revealed in FIGS. 3 and 4, the half-shells 14 are thus in contact with one another at the proximal part of the flats 15 (pivot 23) due to the operation of the spring collar 21 while the half-shells 14 are not in contact at the distal part $\mathbf{14}_1$. The two half-shells 14 thus have an angle between them, the apex whereof constitutes the pivot 23.

In this so-called semi-free position of the half-shells (FIGS. 3 and 4), it should be noted that the half-shells 14 have, at the distal part $\mathbf{14}_1$ a diameter that is greater than the inside diameter of the tubular metal body 2.

According to another feature of the invention, the part $\mathbf{14}_1$ of the half-shells 14 define a bearing surface for the tubular body 2 that allows the half-shells 14 to be brought together to ensure electrical contact between the contact fingers 19 and the pads 7. According to a preferred variation in implementation, the half-shells 14 have at the distal part $\mathbf{14}_1$, a chamfer 25 to assist in inserting into the tubular body 2.

The assembly procedure is directly derived from the foregoing description.

The spring collar 21 surrounds the half-shells 14 to ensure that they are held in position, while the contact fingers 19 are inserted between the two half-shells 14. The insertion of the detector 3 starting at the distal part $\mathbf{14}_1$ of the half-shells 14 leads to pivoting of the two half-shells 14 which remain at rest or in contact about the pivot 23 due to the operation of the spring collar 21. In the case where the contact fingers 19 have a deformable part, it should be noted that the contact fingers 19 exert a force tending to open the two half-shells 14. In this pre-assembly condition, the two half-shells 14 have, at their distal part $\mathbf{14}_1$ a diameter greater than the diameter of the inner bore of the tubular metal body 2.

The insertion of the tubular metal body 2 starting from the distal part $\mathbf{14}_1$ of the half-shells 14 leads to tightening or to bringing together the half shells 14 at the distal part $\mathbf{14}_1$. The insertion of the tube 2 thus loads the contact fingers 19 against the pads 7. The fact of exerting a tightening force only on the proximal part $\mathbf{14}_2$ of the half-shells allows the contact area between the half-shells 14 and the tubular metal body 2 to be limited, thus making assembly easier.

According to an advantageous feature of implementation, the spring collar 21 is assembled on the two half-shells, such that the two half-shells 14 and the spring collar 21 are located within the tubular body on assembly. According to an embodiment illustration particularly in FIGS. 2 and 3, the spring collar 21 is assembled in a rebate 26 provided externally on the two half-shells 14.

Thus, the spring collar 21 settles substantially flush with or possibly sunken with respect to the outer contour 16. It should be noted that in the example illustrated, the outer contour 16 is a smooth surface such that the surface bearing on the external bore of the tube 2 is a continuous surface. Of course, one can contemplate making spurs or projections on the periphery of the outer contour 16 so as to provide multipoint contact with the internal bore of the tube 2.

In the foregoing description, the device 1 is a measurement sensor, for exhaust gas in particular, such that the dielectric component 3 is a detector. Of course, the connection system 11 can be designed to equip an electrical device other than a measuring device. For example, the electrical connection system may provide the electrical connection between a wiring harness and a spark plug or glow plug.

The invention is not limited to the examples described, because various modifications can be applied to it without departing from its scope.

The invention claimed is:

1. An electrical connection system (11) for a vehicle connecting electrical contact pads (7) arranged on the proximal part (32) of an elongated dielectric component (3) with an electrical wiring harness (12), this connection system comprising: two dielectric half-shells (14) assembled face-to-face so as to have on one side a distal part (141) and on the opposite side a proximal part (142), the proximal part of the component being inserted between the two half-shells on the side of the distal part, electrical contact fingers (19) making contact with pads (7), interposed between at least one half-shell and the component, and electrically connected with the wiring harness, a spring collar (21) surrounding the half-shells (14) to provide for holding them in position, characterized in that: the contact fingers (19) each have at least one spring portion (191) pressed on by a half-shell, the half-shells (14) include at the proximal part a pivot (23) such that the half-shells open angularly relative to one another in the direction of the distal part, the spring collar (21) surrounding the half-shells (14) at the proximal part to hold them in the angular open position, the half-shells (14) include together on the outside, at the distal part (14.sub.1), a bearing surface for a tubular body (2) that provides for bringing the half-shells together to ensure electrical contact between the contact fingers (19) and the pads (7).

2. An electrical connection system for a vehicle according to claim 1, characterized in that the spring collar (21) is assembled onto the half-shells (14) such that the half-shells (14) and the spring collar (21) are located within the tubular body (2) on assembly.

3. An electrical connection system for a vehicle according to claim 2, characterized in that the spring collar (21) is assembled in a rebate (26) provided on the outside of the half-shells.

4. An electrical connection system for a vehicle according to claim 1, characterized in that the half-shells (14) together delimit, at the proximal part, a contact area constituting the pivot (13).

5. An electrical connection system for vehicles according to claim 1, characterized in that the contact fingers (19) each include at least one ductile part.

6. An electrical connection system for a vehicle according to claim 1, characterized in that the half-shells (14) together delimit a recess (17) for receiving the proximal part (32) of the component (3), including a stop (18) for said component.

7. An electrical connection system for a vehicle according to claim 1, characterized in that the contact pads (7) are electrically connected to at least one electrode (5) carried by the detector (3).

8. An electrical connection system for a vehicle according to claim 1, characterized in that the contact fingers (19) extend outside the half-shells (14), on the side of the proximal part (142), to allow their connection to the wiring harness.

9. An electrical connection system for a vehicle according to claim 1, characterized in that the half-shells (14) include at their distal part a chamfer (25) to assist insertion into the tubular body (2).

10. An electrical measuring device for a vehicle, for exhaust gases in particular, characterized in that it includes an electrical connection system, according to claim 1, connecting a wiring harness (12) and an elongated dielectric component constituting a detector.

11. An electrical device for a vehicle, characterized in that it includes an electrical connection system according to claim 1, connecting an electrical wiring harness (12) and a spark plug.

* * * * *